United States Patent [19]

Dehne

[11] Patent Number: 4,574,706

[45] Date of Patent: Mar. 11, 1986

[54] CONVEYOR SYSTEM WITH ALTERNATIVE CARRIER PROPULSION

[75] Inventor: Clarence A. Dehne, Farmington Hills, Mich.

[73] Assignee: Jervis B. Webb Company, Farmington Hills, Mich.

[21] Appl. No.: 650,818

[22] Filed: Sep. 13, 1984

[51] Int. Cl.[4] ..... B61B 13/12; B65G 37/00

[52] U.S. Cl. ..... 104/162; 104/172 B; 104/250; 104/292; 198/465.1

[58] Field of Search ..... 104/162, 172 B, 290, 104/292, 293, 249, 250, 252, 172 S; 198/472, 339, 345

[56] References Cited

U.S. PATENT DOCUMENTS

| | | | |
|---|---|---|---|
| 2,619,916 | 12/1952 | Rainier | 104/172 B |
| 3,179,064 | 4/1965 | Dehne | 104/172 S |
| 3,260,220 | 7/1966 | Ludwig | 104/162 |
| 3,286,652 | 11/1966 | Ringwood et al. | 104/162 |
| 3,516,361 | 6/1970 | Hart | 104/293 |
| 3,641,939 | 2/1972 | Remy | 104/293 |
| 4,006,691 | 2/1977 | Kacir et al. | 104/162 |
| 4,269,298 | 5/1981 | Mergl | 198/341 |
| 4,527,611 | 7/1985 | Clark | 198/472 |

FOREIGN PATENT DOCUMENTS

| | | | |
|---|---|---|---|
| 0002526 | 1/1980 | Japan | 104/172 B |

*Primary Examiner*—Randolph A. Reese
*Assistant Examiner*—Donald T. Hajec
*Attorney, Agent, or Firm*—Joseph W. Farley

[57] ABSTRACT

A conveyor has vertically spaced carrier and power tracks respectively supporting carriers and primary pushers, each carrier being propellable by a driving dog movable between retracted and extended positions and drivingly engageable only in the extended position by one of the primary pushers. Carriers are also advanceable along a portion of the carrier track from engagement of their driving dogs by secondary pushers movably connected to a reciprocatable transfer member supported alongside of the power track and driven on forward and return strokes by a linear motor. When operational, the secondary pushers are moved to a driving position, each driving dog engaged by a secondary pusher is held thereby in retracted position, and carriers are advanced by a forward stroke of the transfer member. When non-operational, the secondary pushers remain in a non-driving position, the driving dogs remain in extended position, and carriers are propelled by the primary pushers.

20 Claims, 8 Drawing Figures

CONVEYOR SYSTEM WITH ALTERNATIVE CARRIER PROPULSION

SUMMARY OF THE INVENTION

This invention relates to conveyor systems of the power and free type and to improvements which enable carriers to be forwarded along a portion of such a system by either of two independently operable propelling devices, one of which serves as a backup for the other.

Conventionally, a power and free conveyor system has a carrier track, a plurality of carriers each including a driving trolley supported on the carrier track, and a power track mounted in vertically spaced relation to the carrier track. Carrier propelling means are supported by the power track and include driven pushers projecting toward the carrier track; and, each driving trolley has a driving dog which is movable between extended and retracted positions relative to the pushers, which is biased to the extended position, and which is drivingly engageable in the extended position by one of the pushers. At a normal spacing between the carrier track and the power track, the driving dog in the retracted position is not engageable by a pusher and is movable to and retainable in that position either by a carrier stopping device or by an actuator on the rear of a preceeding carrier in order that a carrier will stop and accumulate behind a preceeding stopped carrier. These conventional carrier propelling means and pushers will be referred to herein as "primary propelling means" and "primary pushers", respectively.

Basically, the present invention provides, in a conveyor system having a carrier track supporting carriers each including a driving trolley with a driving dog movable between an extended and a retracted position, primary and secondary propelling means selectively operable for forwarding carriers along a portion of the carrier track. The primary propelling means includes primary pushers, and a carrier driving dog in its extended position is drivingly engageable by one of the primary pushers but in its retracted position is non-engageable by any of the primary pushers. The secondary propelling means includes one or more secondary pushers each movable between driving and non-driving positions, and a carrier driving dog in its retracted position is drivingly engageable by one of the secondary pushers in the driving position thereof. A driving dog in extended position is not engageable by a secondary pusher in non-driving position. Thus, when the secondary propelling means is operated, the secondary pushers are moved to their driving position and carrier driving dogs drivingly engaged thereby are held in retracted position not engageable by the primary pushers. If the secondary propelling means is not operated, the secondary pushers remain in non-driving position and carrier driving dogs in their extended position are each engageable by one of the primary pushers.

In an embodiment of the invention to be described herein, the secondary propelling means is employed in conjunction with the primary propelling means as a preferred form of propulsion for advancing carriers of a power and free conveyor through a plurality of successive processing stations which are arranged along a portion of the carrier track, and at which carriers are successively stopped by openable and closable stopping devices each having a stop member which when closed, is engaged by and retains a carrier driving dog in retracted position. The secondary propelling means comprises a reciprocatable transfer member, supported in parallel relation with the power track of the primary propelling means and driven on forward and return strokes by a linear motor, the transfer member having a plurality of secondary pushers mounted thereon at a longitudinal spacing corresponding to the spacing between successive processing stations. Each carrier driving dog is provided with a transversely extending driving face, one portion of which is engageable by a primary pusher in the extended position of the driving dog, and another portion of which is engageable in the retracted position of the driving dog by a secondary pusher when moved to driving position. Positioning means, arranged at and between each of the stations, is operable in advance of a forward stroke of the transfer member to move all secondary pushers to driving position engaged with carrier driving dogs in their retracted position; to retain all secondary pushers in such driving position during a forward stroke of the transfer member; and to place all secondary pushers in non-driving position prior to and during a return stroke of the transfer member. In the interval between successive forward strokes of the transfer member, the driving dogs of carriers at the processing stations are held in retracted position by the closed stopping devices.

The primary propelling means normally operates in conjunction with the secondary propelling means to advance carriers to the first of the processing stations and from the last of them. If the secondary propelling means is non-operational, the secondary pushers remain in their non-driving position, and the driving dogs of carriers in the processing stations, when released by opening the stopping devices, move to their extended positions in which each driving dog is engaged by one of the primary pushers and advanced to the next station.

Other features of the invention will appear from the description to follow of the embodiment disclosed in the accompanying drawings.

DESCRIPTION OF THE PREFERRED EMBODIMENT

Figure 1:
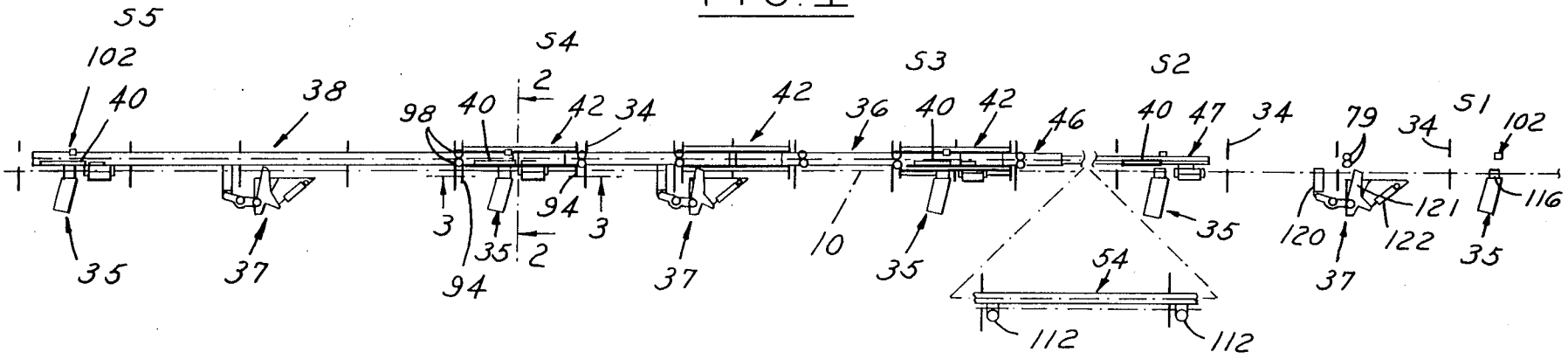
FIG. 1 is a schematic plan view of a portion of a conveyor system incorporating the primary and secondary propelling means of the invention for forwarding carriers through a series of successive processing stations.

FIG. 1 illustrates only that portion of a power and free conveyor system which incorporates the present invention. This system, schematically represented by the broken line 10, is similar to the systems disclosed in applicant's commonly owned U.S. Pat. No. 4,408,540 and pending U.S. Pat. application Ser. No. 06/542,257, and includes the following elements shown in FIG. 2:

- a carrier track 12 composed of a pair of oppositely facing, channel section track members 13 and 14;
- carriers 16, each including a driving trolley 18 supported on the carrier track 12, and one or more load carrying trolleys (not shown) connected to the driving trolley as shown in the disclosures referenced above;
- a power track 20, composed of a pair of track members 21 and 22, mounted in vertically spaced relation to and below the carrier track 12;
- carrier propelling means 24 supported by the power track 20 and including pushers 26 projecting toward the carrier track 12, the pushers being connected to an endless chain 27 which is supported by power trolleys 28 mounted on the power track 20 and which is driven by a suitable drive unit (not shown), in the known manner;
- a driving dog 30 provided on each driving trolley 18, the driving dog 30 being movable between extended and retracted positions relative to the pushers 26; and
- longitudinally spaced yokes 34 which support the carrier and power track members, together with other components of the apparatus to be described.

Figure 2:
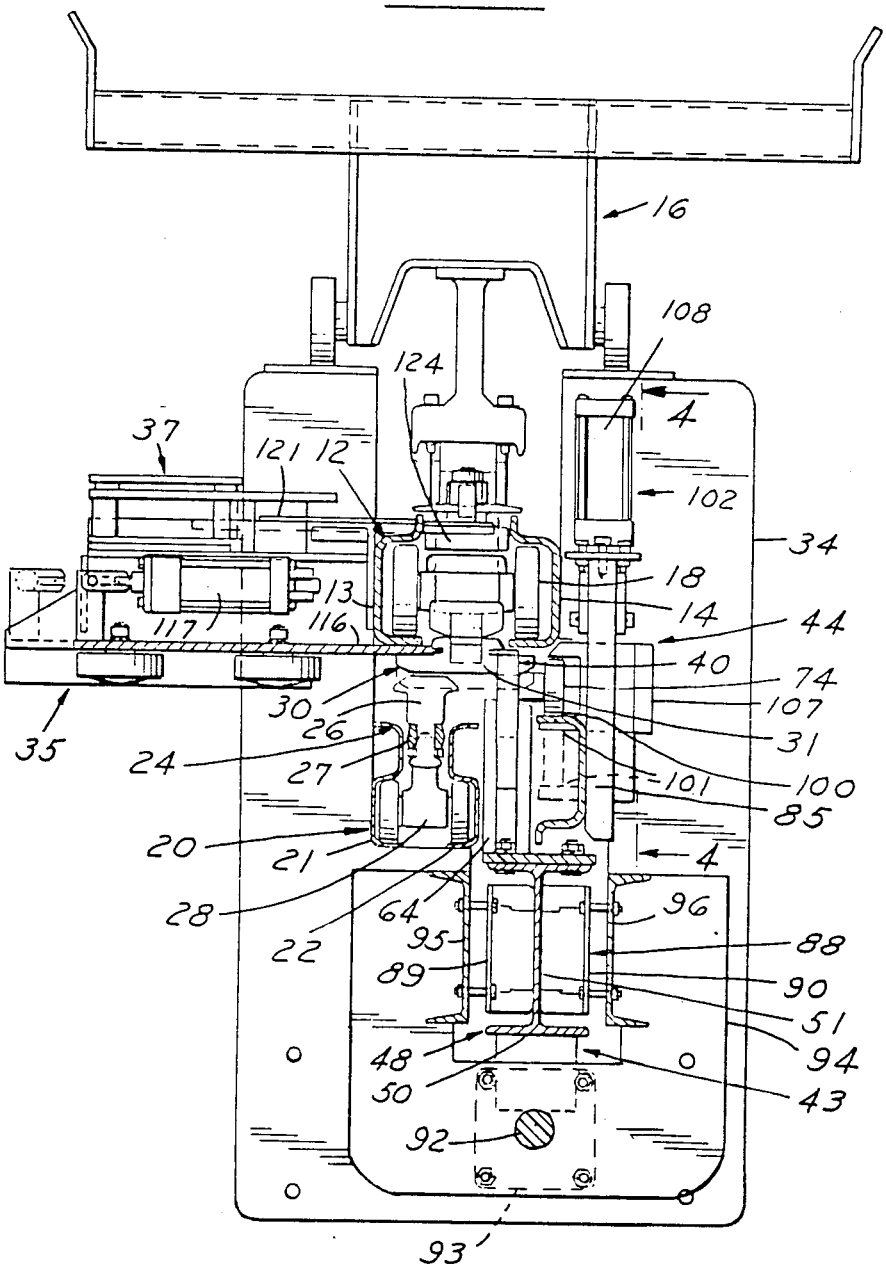
FIG. 2 is a transverse sectional elevation taken substantially as indicated by the line 2—2 of FIG. 1.

In this description, the carrier propelling means 24 and the pushers 26 will be referred to as primary propelling means 24 and primary pushers 26. FIG. 2 shows the driving dog 30 in its retracted position, and in this position a transversely extending driving face 31 on each of the driving dogs 30 is non-engageable by the primary pushers 26. Each driving dog 30 is biased to the extended position (shown in broken lines in FIG. 2) and when it moves downwardly to this position from the retracted position, it is engageable by one of the primary pushers 26.

The portion of the conveyor system 10 shown in FIG. 1 includes a plurality of successive processing stations S1 through S5 arranged along the carrier track 12, and the invention provides secondary propelling means 36 for propelling carriers 16 through these processing stations under conditions requiring each carrier to be stopped at each station in succession and to be rapidly advanced to the following station after the completion of each processing operation on workpieces supported by the carriers. Each of the stations is provided with carrier stopping means 35, and optionally with carrier locating means 37, mounted on the fixed track structure.

In the construction illustrated, the secondary propelling means 36 comprises a linearly movable transfer member 38; a plurality of secondary pushers 40 carried by the transfer member 38 and movable between driving and non-driving positions relative to the driving dog 30; driving means 42 for moving the transfer member 38 along a path of travel, defined by supporting means 43, extending between successive ones of the stations S1, S2, etc., in parallel relation with the power track 20; and, means 44 for positioning the secondary pushers 40 in their driving and non-driving positions. These components of the construction are further described below.

Transfer Member 38 (FIGS. 1–3 and 6–8)

Figure 6:
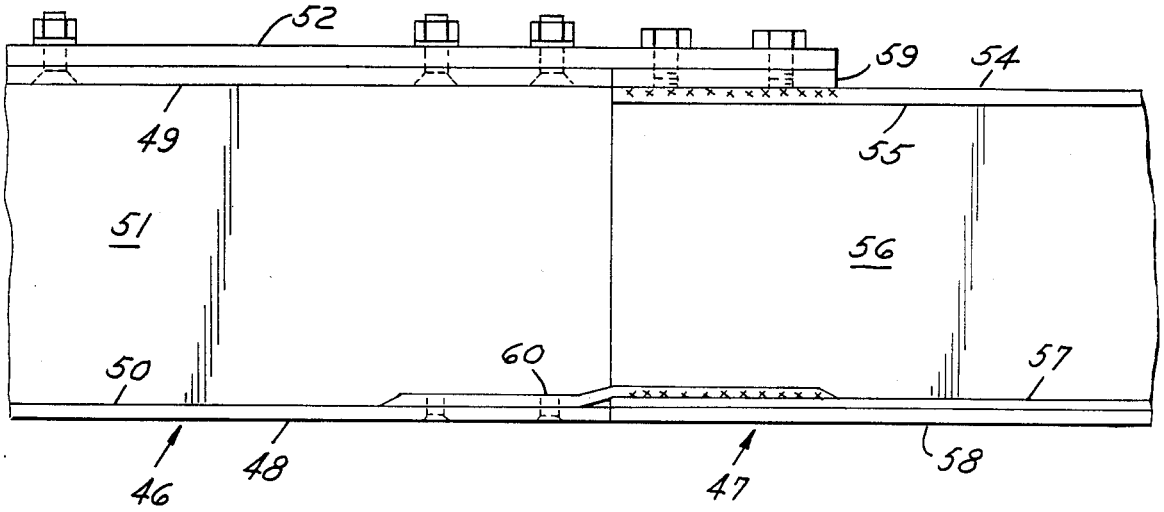
FIG. 6 is a fragmentary side elevation showing a connection between first and second I-section beams forming a transfer member.
Figure 8:
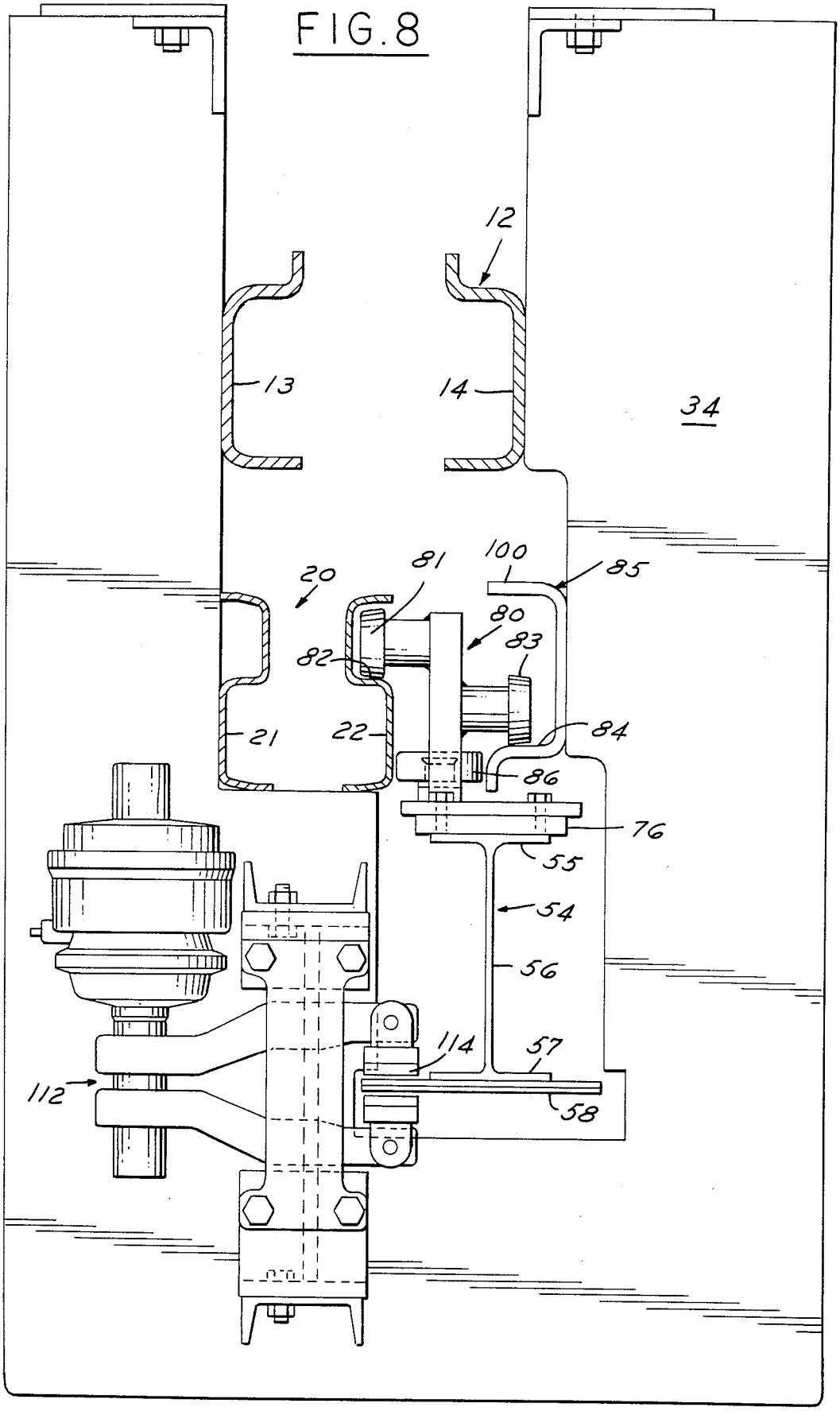
FIG. 8 is a transverse end elevation showing the relation between the transfer member supporting and guide rollers shown in FIG. 7, track surfaces engaged by those rollers, and a caliper brake for the transfer member.

The transfer member 38 is a composite beam consisting of a first portion 46 and a second portion 47 forming a linear extension of the first portion, the two portions being joined in end-to-end relation by connecting means shown in FIG. 6. The first portion 46 is made of an I-section beam 48 having an upper flange 49, a lower flange 50 and a vertical web 51. A reinforcing plate 52 is bolted to the upper flange 49. The second portion 47 is also made of an I-section beam 54 with an upper flange 55, a vertical web 56 and a lower flange 57. A plate 58 is secured to the length of the lower flange 57 and extends transversely to either side thereof as shown in FIG. 8.

As shown in FIG. 6, the sectional dimensions of the I-beam 54 are less than those of the I-beam 48. The connection is established by an extension of the plate 52 of the I-beam 48 overlapping a spacer plate 59 welded to the upper flange 55 of the I-beam 54; and by offset splice plates 60 welded to the lower flange 57 of the I-beam 54 and fastened to the lower flange 50 of the I-beam 48. The I-beams 48 and 54 are respectively made of aluminum and steel for reasons to be described.

Secondary Pushers 40 (FIGS. 1–3 and 7)

Figure 3:
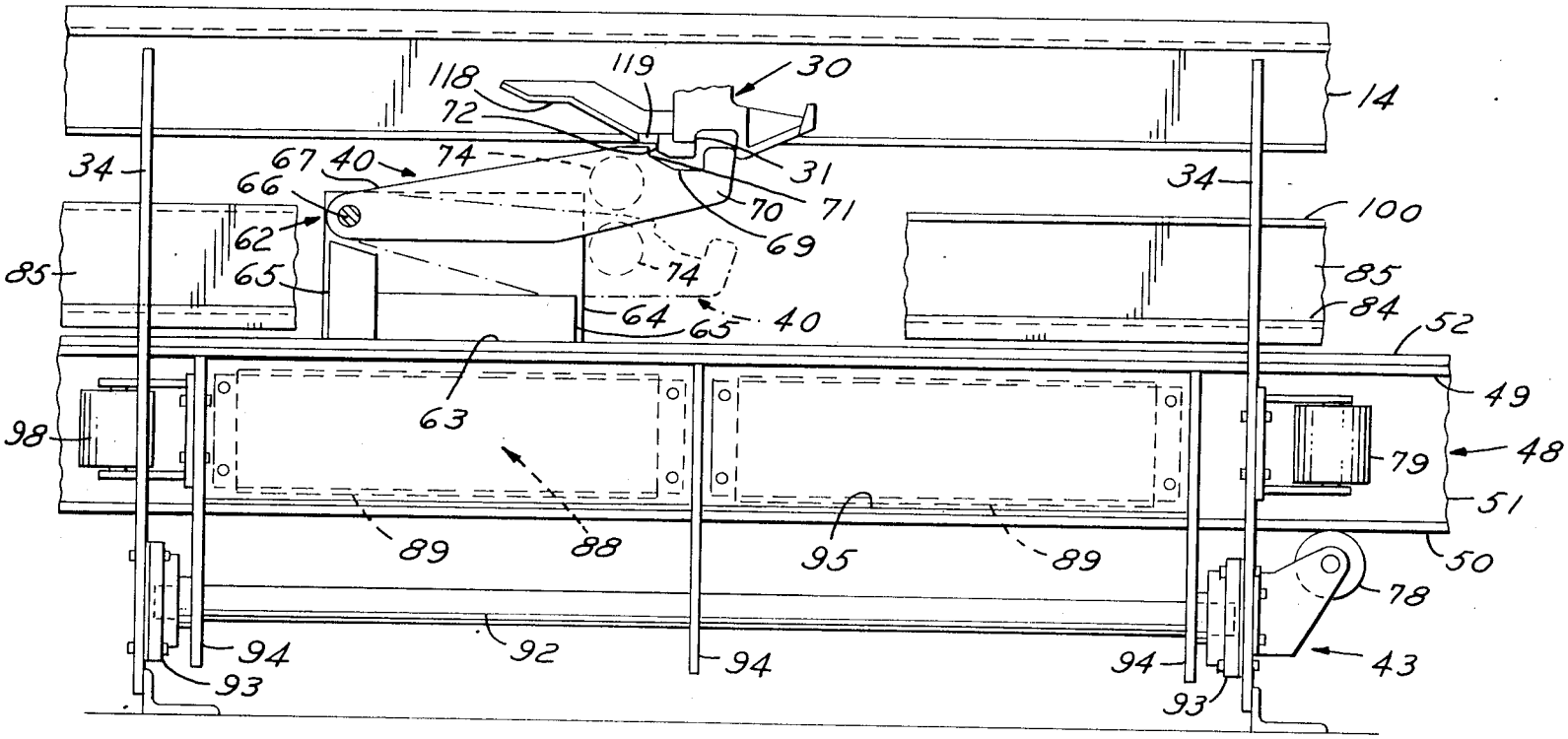
FIG. 3 is a fragmentary side elevation, taken substantially as indicated by the arrows 3—3 of FIG. 1, showing the relation between a carrier driving dog and a secondary pusher.
Figure 4:
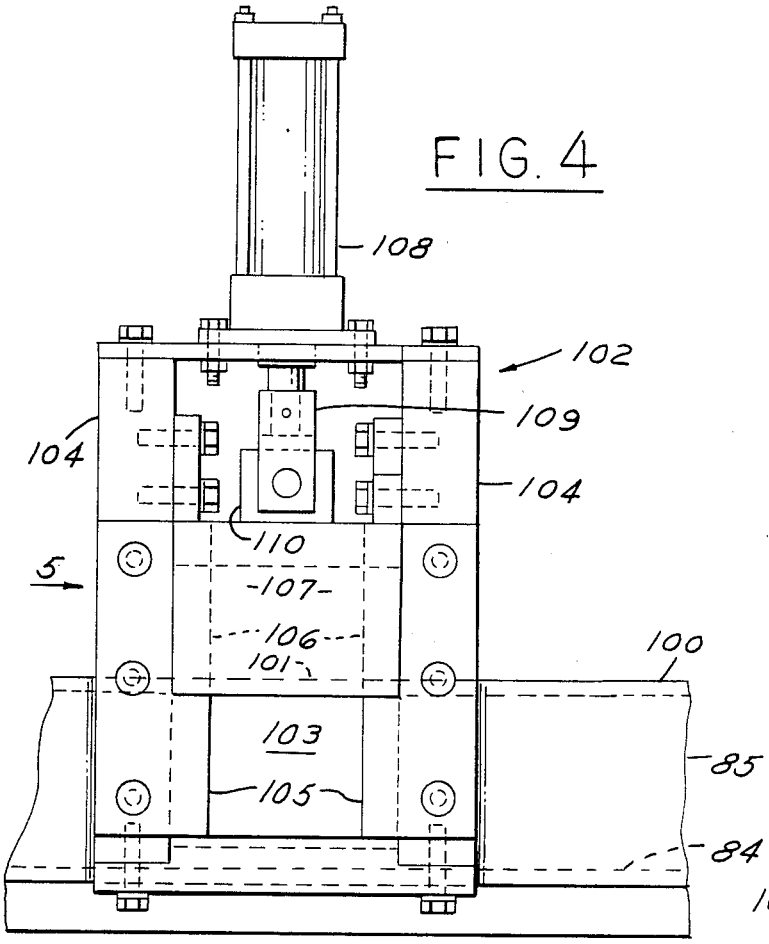
FIG. 4 is a fragmentary side elevation, taken as indicated by the arrows 4—4 of FIG. 2, showing a secondary pusher positioning device.

These secondary pushers 40 are part of pusher assemblies 62 attached to the top of the transfer member 38, the longitudinal spacing between successive pusher assemblies 62 corresponding to the longitudinal spacing between successive stations S1, S2, etc. Each pusher assembly 62 includes a horizontal mounting plate 63, a pair of vertical plates 64 transversely spaced by a separator 65, and a transverse pivot 66 carried by the vertical plates 64, the secondary pusher 40 being located between the plates 64 and having one end 67 connected to the pivot 66. The other end 68 of each secondary pusher 40, as shown in FIG. 3, is formed with a recess 69 adapted to mate with the contour of the driving dog 30, and with a driving projection 70 which is engageable with the driving face 31 of the driving dog 30. The recess 69 includes a holdback surface 71 engageable by the portion 72 of the driving dog 30 facing oppositely from the driving face 31. A follower 74 in the form of a roller is mounted on one side of each secondary pusher 40 adjacent to its end 68 and forms a part of the positioning means 44 to be described.

Along the first portion 46 of the transfer member 38, pusher assemblies 40 are attached to the upper flange 49 of the I-beam 48, as shown in FIG. 3, and the mounting plate 63 of each pusher assembly forms a continuation of the reinforcing plate 52. Pusher assemblies 40 are attached to the second portion 47 of the transfer member 38 in the manner shown in FIG. 7, a spacer 76 being employed between the upper flange 55 of the I-beam 54 and the mounting plate 63 so that all pusher assemblies 40 along the length of the transfer member 38 are at substantially the same elevation.

Driving Means 42 and Supporting Means 43 (FIGS. 1–3, 7 and 8)

Figure 7:
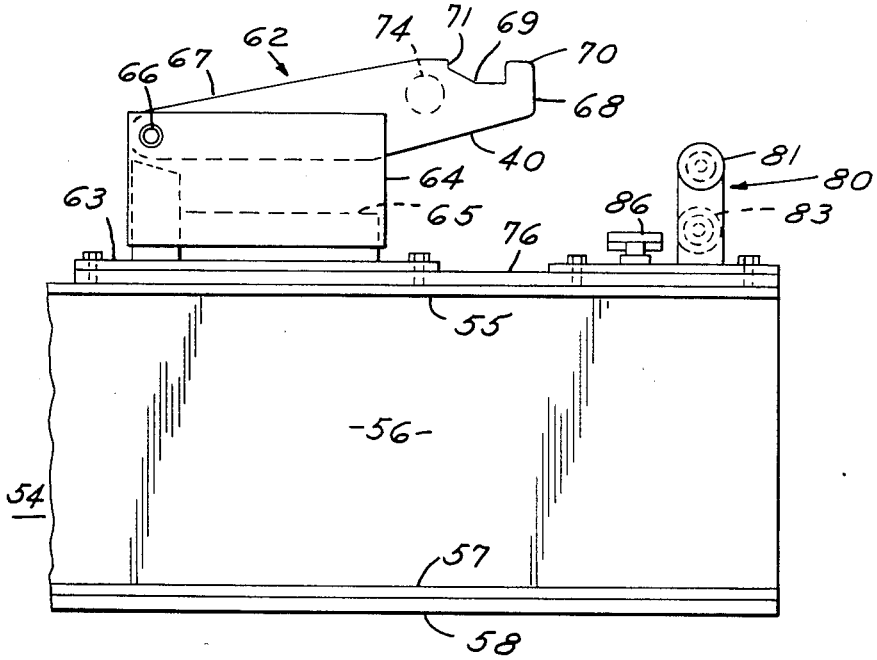
FIG. 7 is a fragmentary side elevation showing one end of the transfer member.

The transfer member 38 is supported for linear, reciprocatable movement by the supporting means 43 which include a plurality of supporting rollers 78 (FIG. 3) engaged by the bottom surface of the transfer member, and pairs (FIG. 1) of rollers 79 engaged by the opposed surfaces of the vertical webs 51 or 56 of the transfer member. The rollers 78 and 79 are attached to a suitable number of the track yokes 34. Additionally, a suspension and guide assembly 80, shown in FIGS. 7 and 8, is attached to the top of the transfer member 38 at each of its ends. This assembly 80 includes a first suspension roller 81 which engages a track surface 82 of the power track member 22; a second suspension roller 83 which engages a track surface 84 of a positioning track member 85 that extends alongside of the path of travel of the transfer member 38; and a guide roller 86 which engages vertically disposed surfaces of the track members 22 and 85.

The driving means comprises one or more linear motors 88 adapted to move the transfer member 38 on forward and return strokes. Each motor 88 has a stator formed by at least a pair of stator elements 89 and 90 and a reactor formed by a portion of the vertical web 51 of the I-beam 48. As previously mentioned, the I-beam 48 is composed of aluminum, or other material particularly suited to act as the reactor, and the length of the I-beam 48 is only that required for the reactor, considering the number of linear motor stator elements necessary to drive the transfer member the desired travel distance. The steel I-beam 54 reduces the cost of the remaining length of the transfer member 38.

Stator elements 89 and 90 are mounted in opposed relation to the reactor portion 51 by stator supporting means shown in FIGS. 2 and 3. A pivot shaft 92, mounted between adjacent track yokes 34 in bearings 93, defines a pivotal axis spaced vertically from the transfer member 38 and extending substantially parallel to the path of movement thereof. A plurality of transverse yokes 94 fixed to the shaft 92 are connected to longitudinal mounting beams 95 and 96 to which the stator elements 89 and 90 are respectively secured. A pair of stator guide rollers 98 (FIG. 3) attached to an endmost yoke 94 engage opposite sides of the web 51 of the transfer member in a manner similar to the guide rollers 79, except that the stator guide rollers 98 produce compensating transverse movements of the stator elements 89 and 90 as may be required to minimize variations in the gap or clearance between the stator and reactor of the linear motor 88.

Positioning Means 44 (FIGS. 1–5)

Each of the secondary pushers 40 is movable between the driving position shown in solid line in FIG. 3 and the non-driving position shown in broken line and is biased to the latter position by its mass acting about the pivot 66. The positioning means, which acts to move each secondary pusher 40 to driving and non-driving position on the forward and return stroke of the transfer member, respectively, includes a cam track 100, formed by an upper horizontal surface of the positioning track member 85, and a movable section 101 provided in the cam track 100 at each of the processing stations S1–S5. Each movable track section 101 is connected to actuating means 102 last shown in FIGS. 2–5.

Figure 5:
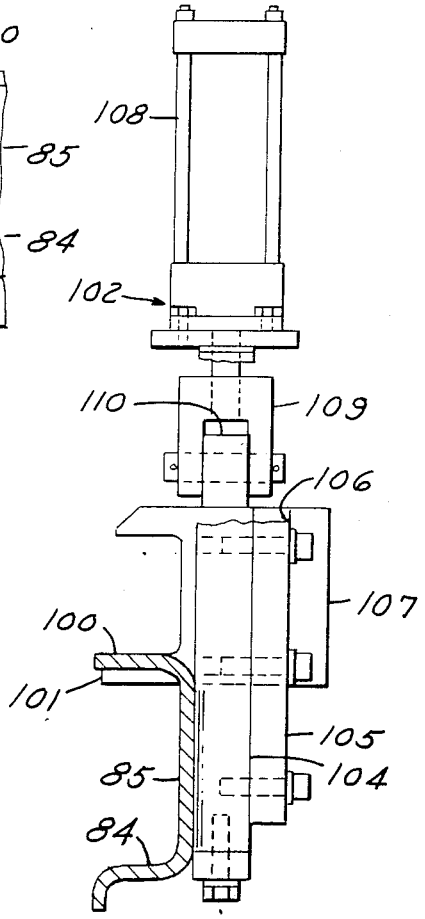
FIG. 5 is an end elevation of the positioning device taken as indicated by the arrow 5 of FIG. 4.

The actuating means 102, which is supported by the positioning track member 85 at a cut-out portion 103 provided therein, includes a pair of parallel vertical guides 104 and gibs 105 secured to the guides 104, the gibs 105 being slidably engaged by slots 106 in opposite sides of a block 107 formed integrally with the movable track section 101. An acutuating cylinder assembly 108 is connected by a clevis 109 to a tang 110 on the block 107. The movable track section 101 preferably has a U-shaped section, as shown in FIGS. 2 and 5, adapted to positively engage the follower roller 74 and move the secondary pusher 40 each of its positions.

Summary of Operation

Conventional control and sensing elements, known in the art and not shown, are employed to operate the previously described components in the manner indicated below.

FIG. 1 illustrates the transfer member 38 at the end of a forward stroke in a forward and return cycle; and, as a result of this forward motion, carriers 16 have been advanced to each of stations S2 through S5 and the components are in the following condition:

The transfer member 38 has been stopped and is held in the forward position by activation of caliper brake assemblies 112, one of which is shown in FIG. 8, having pads 114 which engage the plate 58 on the I-beam 54 of the second portion 47 of the transfer member.

The stopping means 35 at each of the stations has been closed, i.e., is in the position shown in FIG. 2 in which a stop plate 116, transversely reciprocatable relative to the carrier track 12 by an actuator 117, extends into the path of travel of the carrier driving dog 30 and has been engaged thereby, retaining the driving dog 30 in its retracted position. Engagement of a closed stop plate 116 by a driving dog 30 takes place between the stop plate and the driving dog surfaces shown in FIG. 3, namely, an inclined cam surface 118 which produces retracting movement of the driving dog 30, a horizontal retaining surface 119 which moves into overlapping engagement with the stop plate 116, and the surface 72 which abuts the edge of the stop plate 116.

Each locating means 37 has been extended to the FIG. 1 position in which arms 120 and 121, pivotally movable in scissors fashion by an actuator 122, extend across the carrier track 12 and engage the forward and rearward guide rollers of a carrier load carrying trolley. FIG. 2 illustrates a rearward guide roller 124 engaged by the locating arm 121.

The operation then proceeds in the following sequence:

1. All actuating cylinders 108 are operated to lower the movable cam track sections 101, moving all secondary pushers 40 from driving position to the non-driving broken-line position shown in FIG. 3, and disengaging the secondary pushers 40 from the carrier driving dogs 30 which are retained in retracted position by the closed stop plates 116.
2. The caliper brakes 112 are released.
3. The linear motors 88 are energized to drive the transfer member 38 on a return stroke.
4. At the end of the return stroke, the caliper brakes 112 are engaged and the transfer member 38 is held in return position awaiting the next cycle. During the waiting period, a carrier 16 is advanced into station S1 by a primary pusher 26 of the power and free conveyor 10, and the driving dog 30 of this carrier engages the closed stop plate 116 at station S1 and is moved to retracted position, disengaged from a primary pusher 26. A carrier in station S5 is released by opening the stop plate 116 at that station, thus permitting the driving dog 30 of that carrier to fall to extended position and to be engaged by the next advancing primary pusher 26 of the conveyor 10.
5. At the start of a new cycle, all actuating clinders 108 are operated to raise the movable cam track sections 101, moving all secondary pushers 40 into the full-line driving position shown in FIG. 3.

6. The arms 120 and 121 of all locating means 37 are moved to retracted position by the actuators 122.
7. All stop plates 116 are moved to open position disengaged from the carrier driving dogs 30 which remain in retracted position, engaged by the secondary pushers 40. The brakes 112 are released.
8. The linear motors 88 are energized to drive the transfer member 38 on a forward stroke.
9. During forward movement of the transfer member 38, all stop plates 116 are moved to closed position.
10. At the end of the forward stroke of the transfer member 38, the brakes 112 are engaged, the arms 120 and 121 of all locating means are then extended, and the components are again in their illustrated condition.

If for any reason the secondary propelling means 36 is not operated and the secondary pushers 40 are in their nondriving position, carriers can be advanced by the primary propelling means. The driving dog 30 of a carrier 16 in any of the stations S1–S5 will fall to the extended position when the stopping devices 35 are opened, will be engaged by one of the primary pushers 26, and will be advanced thereby to the next station.

Although the secondary propelling means in the embodiment of the invention described includes the reciprocatable transfer member 38 on which the secondary pushers 40 are mounted, it will be apparent that other specific forms of secondary propelling means can be employed in practicing the invention. For example, secondary pushers, carried by an independently drivable endless chain and movable to driving position as required, can be employed either as a preferred or as a backup form of carrier propulsion where desired in a power and free conveyor system.

What is claimed is:

1. In a conveyor system having a carrier track, carriers each including a driving trolley supported on the carrier track, a power track mounted in vertically spaced relation to the carrier track, carrier propelling means supported by the power track and including primary pushers projecting toward the carrier track, each driving trolley having a driving dog movable between extended and retracted positions relative to said primary pushers and engageable in the extended position by one of said primary pushers, and a plurality of successive processing stations arranged along at least a portion of the carrier track, the improvement comprising:

secondary propelling means for propelling carriers through said plurality of processing stations, and including at least one secondary pusher movable between driving and non-driving positions relative to said driving dog;

driving means for moving said secondary propelling means;

and means supporting said secondary propelling means for movement along a forwarding path of travel extending between successive ones of said plurality of processing stations in parallel relation with said power track, said driving dog in said retracted position thereof being engageable by said secondary pusher in said driving position thereof, and said driving dog in said extended position thereof being engageable by one of said primary pushers and being non-engageable by said secondary pusher in said non-driving position thereof.

2. A conveyor system according to claim 1 wherein said secondary propelling means includes a linearly movable transfer member, said driving means being adapted to move said transfer member on forwarding and return strokes;

mounting means connecting said secondary pusher to said transfer member for movement between driving and non-driving positions relative to said driving dog; and means for positioning said secondary pusher in driving position on the forwarding stroke of said transfer member and in non-driving position on the return stroke of said transfer member.

3. A conveyor system according to claim 2 wherein said driving means comprises a linear motor having a stator and a reactor, said reactor being formed by at least a portion of said transfer member.

4. A conveyor system according to claim 3 wherein said transfer member includes a first portion forming said reactor and a second portion forming a linear extension of said first portion, and a plurality of secondary pushers mounted on said first and second portions of said transfer member at a spacing between successive secondary pushers corresponding to the spacing between said successive processing stations.

5. A conveyor system according to claim 2 wherein said means for positioning said secondary pusher comprises a follower connected thereto, a cam track mounted adjacent to the path of travel of said transfer member, said cam track being engageable by said follower and being adapted to maintain said secondary pusher in the driving position thereof on said forwarding stroke of said transfer member.

6. A conveyor system according to claim 5 wherein said means for positioning said secondary pusher further comprises a movable section of said cam track at each of said processing stations and engageable by said follower; and actuating means for moving said movable track section between positions corresponding to the driving and non-driving positions of said secondary pusher.

7. A conveyor system according to claim 6 further comprising carrier stopping means at each of said successive stations, each stopping means comprising a stop member movable between operable and inoperable positions relative to said driving dog and adapted in said operable position to engage and retain said driving dog in retracted position.

8. A conveyor system according to claim 7 further comprising carrier locating means at each of said successive stations for releasably engaging carriers at said successive stations.

9. A conveyor system according to claim 1 wherein said secondary propelling means comprises a reciprocatable transfer member, said driving means comprises a linear motor adapted to move said transfer member on forwarding and return strokes, said linear motor having a reactor formed by at least a portion of said transfer member and having a stator formed by at least a pair of stator elements, and stator supporting means for mounting said stator elements in opposed relation to said reactor portion of said transfer member.

10. A conveyor system according to claim 9 wherein said stator supporting means includes pivot means for defining a pivotal axis spaced vertically from said transfer member and extending parallel to the path of movement thereof, said stator supporting means being connected to said pivot means, and guide rollers are carried by said stator supporting means, said guide rollers being engageable by opposite sides of said transfer member.

11. In a conveyor system having a carrier track and carriers each including a driving trolley supported on the carrier track, each driving trolley having a driving dog movable between an extended position and a retracted position, the improvement comprising:

primary and secondary propelling means selectively operable for forwarding carriers along at least a portion of said carrier track;

said primary propelling means including primary pushers, said driving dog in said extended position being drivingly engageable by one of said primary pushers and being non-engageable by said primary pushers in said retracted position; and, said secondary propelling means including at least one secondary pusher movable between a driving position and a non-driving position, said driving dog in said retracted position being drivingly engageable by said secondary pusher in said driving position and said driving dog in said extended position being non-engageable by said secondary pusher in said non-driving position.

12. A conveyor system according to claim 11 further comprising means for selectively positioning said secondary pusher in said driving position.

13. A conveyor system according to claim 11 wherein said primary and secondary propelling means are arranged so that their respective pushers are in side-by-side relation, and said driving dog is provided with a driving face extending transversely relative to said carrier track, one portion of said driving face being engageable by one of said primary pushers and another portion of said driving face being engageable by said secondary pusher.

14. A conveyor system according to claim 13 wherein said secondary propelling means comprises a transfer member, said secondary pusher being carried by said transfer member, means for reciprocatably supporting said transfer member, driving means for moving said transfer member on forwarding and return strokes, and means for selectively positioning said secondary pusher in said driving position on said forwarding stroke.

15. A conveyor system according to claim 14 wherein said transfer member comprises a beam having a vertical web;

said driving means comprises a linear motor having a stator and a reactor, said reactor being formed by at least a portion of said vertical web, said stator comprising at least a pair of stator elements; and stator supporting means for mounting said stator elements on opposite sides of said vertical web portion.

16. A conveyor system according to claim 15 wherein said stator supporting means includes pivot means for defining a pivotal axis spaced vertically from said transfer member and extending substantially parallel to the path of movement of said transfer member, said stator supporting means being connected to said pivot means and including guide rollers engageable by opposite sides of said transfer member.

17. A conveyor system according to claim 15 wherein said transfer member comprises first and second beams, said first beam having said vertical web portion and being composed of a material particularly suited to act as said reactor, connecting means for joining said first and second beams in end-to-end relation.

18. A conveyor system according to claim 17 wherein said second beam includes a longitudinally extending brake plate, and fixedly mounted caliper brake means is provided for engaging said brake plate.

19. A conveyor system according to claim 14 wherein said secondary propelling means includes a trackway, and said means for selectively positioning said secondary pusher in said driving position comprises a follower element on said secondary pusher, a track surface on said trackway engageable by said follower element, said track surface including vertically movable portions engageable by said follower element at the end of the forwarding and return strokes of said transfer member, and actuating means for moving said vertically movable portions between positions corresponding to the driving and non-driving positions of said secondary pusher.

20. A conveyor system according to claim 19 wherein supporting and guide roller means are carried by said transfer member for engaging said trackway.

* * * * *